US006955571B2

(12) United States Patent
Fujii

(10) Patent No.: US 6,955,571 B2
(45) Date of Patent: Oct. 18, 2005

(54) FUSE CONNECTOR AND A TERMINAL FITTING FOR A CONNECTOR

(75) Inventor: Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/744,336

(22) Filed: Dec. 23, 2003

(65) Prior Publication Data

US 2004/0157503 A1 Aug. 12, 2004

(30) Foreign Application Priority Data

Dec. 24, 2002 (JP) ..... 2002-371707
Dec. 24, 2002 (JP) ..... 2002-371708

(51) Int. Cl.[7] ..... H01R 11/22; H01R 13/11
(52) U.S. Cl. ..... 439/856; 439/857
(58) Field of Search ..... 439/856–857, 439/842–843, 849–852; 337/187

(56) References Cited

U.S. PATENT DOCUMENTS 5,049,095 A * 9/1991 Gugelmeyer ..... 439/856
5,683,267 A 11/1997 Ribbeck et al. ..... 439/395
5,980,336 A * 11/1999 Hall et al. ..... 439/843
6,524,142 B2 * 2/2003 Heimueller ..... 439/852

FOREIGN PATENT DOCUMENTS

JP 8-273710 10/1996

* cited by examiner

*Primary Examiner*—Michael C. Zarroli
(74) *Attorney, Agent, or Firm*—Gerald E. Hespos; Anthony J. Casella

(57) ABSTRACT

A terminal fitting (20) has a pair of sidewalls (25) standing up from a bottom wall (24) toward an inter-terminal space (12). A pair of resilient contact pieces (30) are formed by cutting parts of the sidewalls (25) and bending the cut parts inward, and the sidewalls (25) are formed with frame-shaped portions (32) extending along the edges of openings (31) left in the sidewalls (25) upon forming the resilient contact pieces (30). Even if an external matter comes closer to the resilient contact pieces (30), it contacts only the frame-shaped portions (32), but cannot come into contact with the resilient contact pieces (30).

15 Claims, 11 Drawing Sheets

FUSE CONNECTOR AND A TERMINAL FITTING FOR A CONNECTOR

BACKGROUND OF THE INVENTION

1. Field of the Invention

The invention relates to a fuse connector and a terminal fitting for a fuse connector.

2. Summary of the Invention

A known fuse connector has upper and lower terminal fittings accommodated in a housing with an inter-terminal space therebetween. Each of the upper and lower terminal fittings has a pair of resilient contact pieces. A fuse is mounted into the housing from the front to insert upper and lower tab terminals of the fuse between resilient contact pieces. Tab terminals that are vertically larger than the terminal fittings will bulge into the inter-terminal space between the resilient contact pieces. Thus, the terminal fittings need to be constructed so that the tab terminals can be inserted between the resilient contact pieces both from the front and from the inter-terminal space.

Japanese Unexamined Patent Publication No. H08-273710 discloses a terminal fitting with a bottom wall and left and right side walls that stand up from the bottom wall. The terminal fitting also has two resilient contact pieces, which together have a tulip shape. The base ends of the resilient contact pieces are supported on the side walls. The terminal fittings then extend forward to be exposed so that the tab terminal can be inserted between the resilient contact pieces from the front and from above.

The above-described resilient contact pieces may be deformed by interference with external matter before the terminal fitting is accommodated in the housing. As a result, a specified contact pressure cannot be secured and a contact error may occur between the terminal fitting and the fuse.

An electrical connection test is conducted in the above-described fuse connector when the terminal fittings are in the housing. This test is conducted by inserting an electrical connection test probe from the front and bringing the leading end of the probe into contact with the front ends of the resilient contact pieces of the above-described terminal fitting. Forceful engagement by the probe can deform the resilient contact pieces. The deformed resilient contact pieces cannot ensure a specified contact pressure, and can cause a contact failure between the terminal fittings and the fuse.

The invention was developed in view of the above problem and an object thereof is to improve the reliability of a connector.

SUMMARY OF THE INVENTION

The invention relates a fuse connector with a housing and at least two terminal fittings accommodated in the housing. Each terminal fitting has at least one resilient contact piece. A fuse is mountable into the housing in an insertion direction. The fuse has at least two tab terminals that are connectable with the corresponding resilient contact pieces so that the two terminal fittings are connected electrically by the fuse. Each terminal fitting has a base wall and at least one side wall extending from the base wall. The at least one resilient contact piece is formed by cutting parts of the respective side walls and bending the cut parts inward. The side wall is formed with a frame-shaped portion extending substantially along the edge of an opening formed in the side wall when the resilient contact piece is formed. External matter that comes close to the resilient contact piece contacts only the frame-shaped portion, but does not contact the resilient contact piece. Accordingly, external matter is substantially prevented from interfering with the resilient contact pieces, thus improving reliability of the terminal fitting and the respective connector.

The housing preferably is vertically symmetrically and accommodates the terminal fittings while defining an inter-terminal space therebetween.

At least a part of each frame-shaped portion preferably is folded and laid over to enhance the rigidity of the frame-shaped portion. Thus, external matter will not deform the frame-shaped portion and interfere with the resilient contact pieces.

Extending ends of the side walls preferably are connected by at least one ceiling wall in areas of the side walls behind the resilient contact pieces. Thus, a substantially rectangular tube is formed by the base wall, the opposite side walls and the ceiling wall. The rectangular tube is difficult to deform. More particularly, the side walls and the frame-shaped portions continuous therewith are not easily deformed, and will not incline inward or outward. Thus, interference of external matter with the resilient contact pieces due to deformation of the frame-shaped portions is prevented. Further, the rectangular tube is behind the resilient contact pieces, and is not a hindrance when the tab terminal of the fuse contacts the resilient contact pieces.

A lower protection wall preferably projects in from the front edge of the base wall and lateral protection walls extend in from the front edges of the side walls. The inner edge of the lower protection wall and the opposite edges of the lateral protection walls are near each other or are substantially in contact. The lateral protection walls and the frame-shaped portions will not incline inward and external matter will not interfere with the resilient contact pieces due to deformation of the frame-shaped portions.

Projections preferably stand up at positions on the bottom wall outward from the corresponding resilient contact pieces. The outer surfaces of the resilient contact pieces are exposed to the outside through the openings created in the side walls upon forming the resilient contact pieces. Thus, there is a possibility that external matter will interfere sideways with the resilient contact pieces from the outside. However, the resilient contact pieces are protected from such an interference by the protections at the outer sides of the resilient contact pieces.

The projections preferably are configured to contact the resilient contact pieces for preventing the resilient contact pieces from undergoing deformation beyond their resiliency limit. Thus, the shape of the terminal fitting can be simplified as compared to a case where excessive deformation preventing portions are formed separately from the projections.

The resilient contact pieces preferably are cantilevered forwardly on sidewalls that extend from a base wall of the terminal fitting. A first portion of each resilient contact piece is configured to contact the corresponding tab terminal. A second portion of each resilient contact piece does not correspond to the tab terminal and has a front-end portion cut to recede back from the first portion. A probe contact projects from the front edge of the base wall and corresponds to the second portion. The probe contact is disposed for contact with the probe. Accordingly, the resilient contact pieces cannot be deformed and damaged by a probe for electrical connection test. Thus, reliability of the terminal fitting and the respective connector are improved.

The probe contact could be pushed and inclined back toward the resilient contact pieces by the probe. However, the probe contact will not interfere with the resilient contact pieces and there is no likelihood of damaging the resilient contact pieces because the cut portions are formed at the front ends of the resilient contact pieces. Further, each resilient contact piece is comprised of the first portion corresponding to the tab terminal of the fuse and the second portion not corresponding to the tab terminal and has a large width along the vertical direction. Thus, the spring rigidity of the resilient contact pieces is enhanced and a high contact pressure can be ensured.

The cut portion preferably is formed in an area of each resilient contact piece before a touching portion engageable with the tab terminal.

The side walls preferably extend more forward than the front ends of the resilient contact pieces and are formed with lateral protection walls that extending in at the front edges of the side walls. The lateral protection walls protect the resilient contact pieces from interference from external matter or from the probe.

The front surfaces of the lateral protection walls and the front surfaces of the contact portion preferably are substantially flush and the corresponding or lower edges of the lateral protection walls are in proximity to or in contact with the upper edge of the contact portion.

A part of the probe could be displaced up toward the resilient contact pieces from the contact portion. However, a portion of the probe displaced from the contact portion will contact the lateral protection walls. Thus, a pushing force from the probe can be exerted on the contact portion and on the lateral protection walls. Accordingly, the pushing force exerted on the contact portion is alleviated, and the deformation of the contact portion is prevented.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
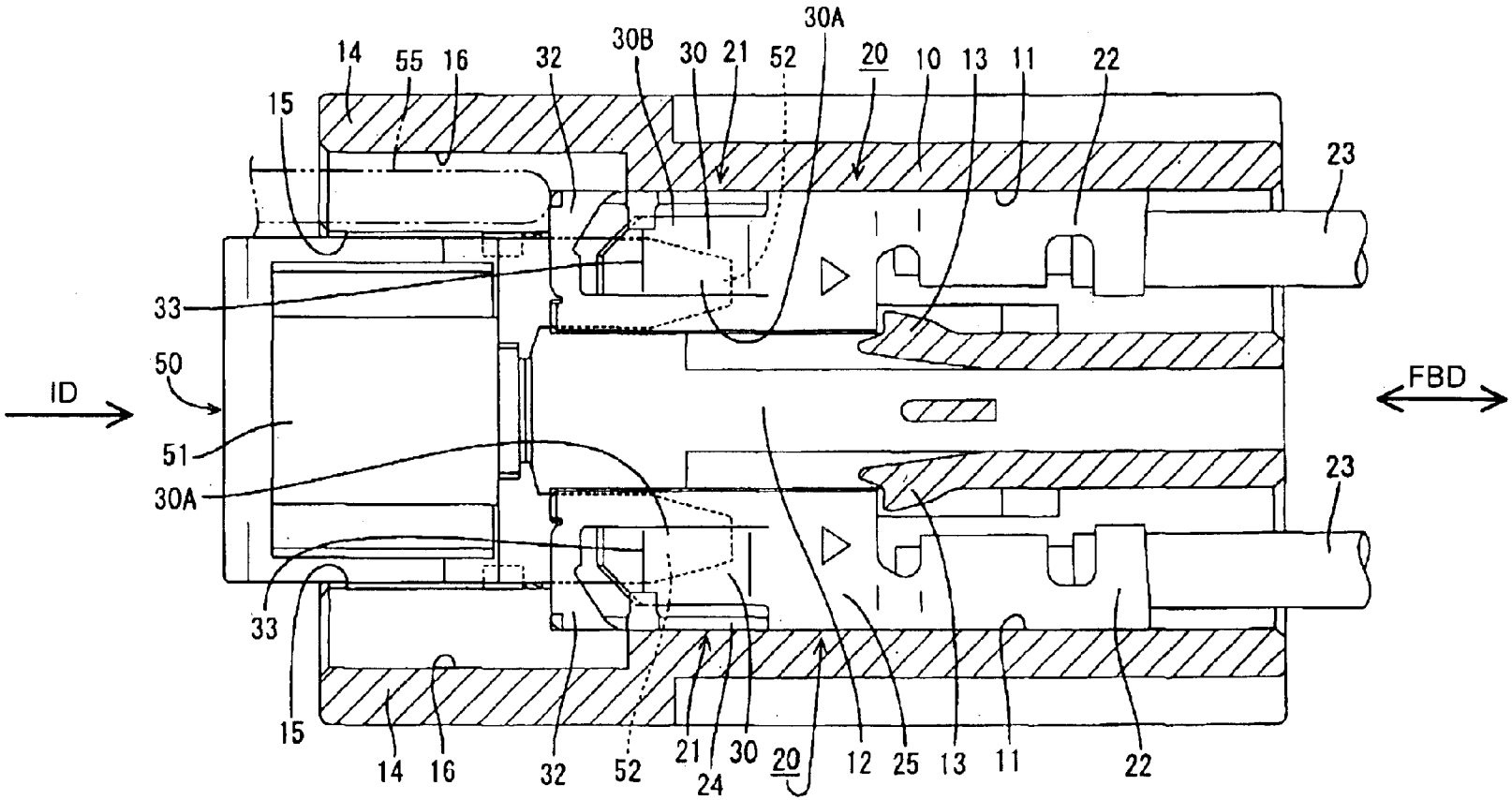
FIG. 1 is a vertical section showing a state where terminal fittings and a fuse are mounted in a housing according to one embodiment of the invention.
Figure 2:
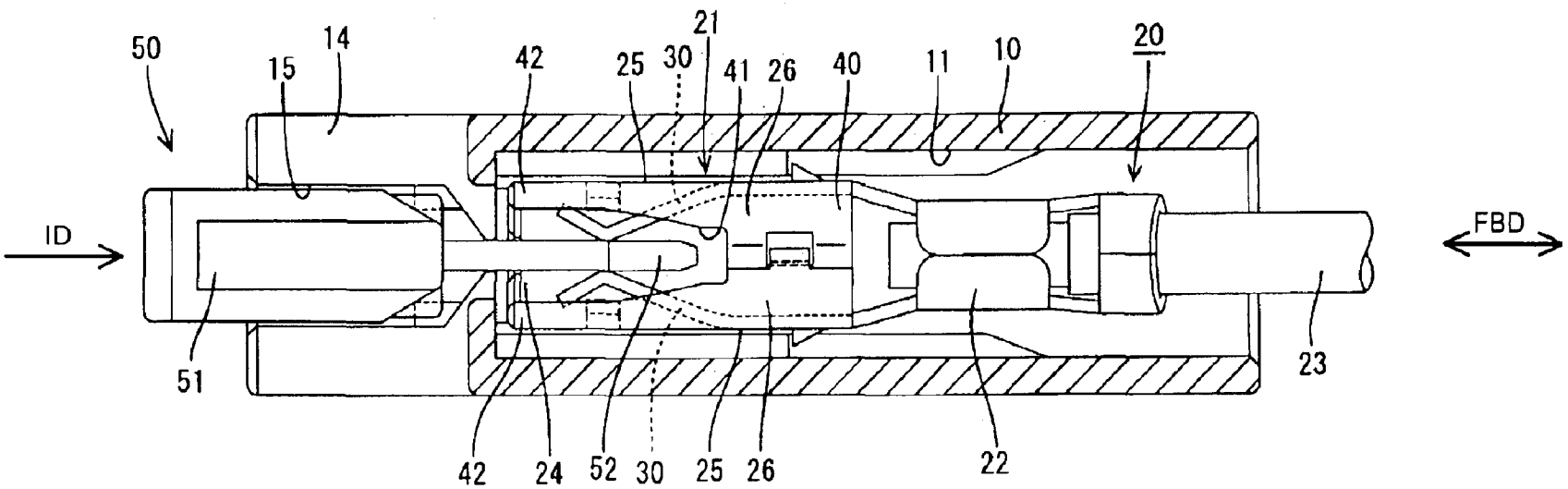
FIG. 2 is a horizontal section showing the state where the terminal fittings and the fuse are mounted in the housing.
Figure 3:
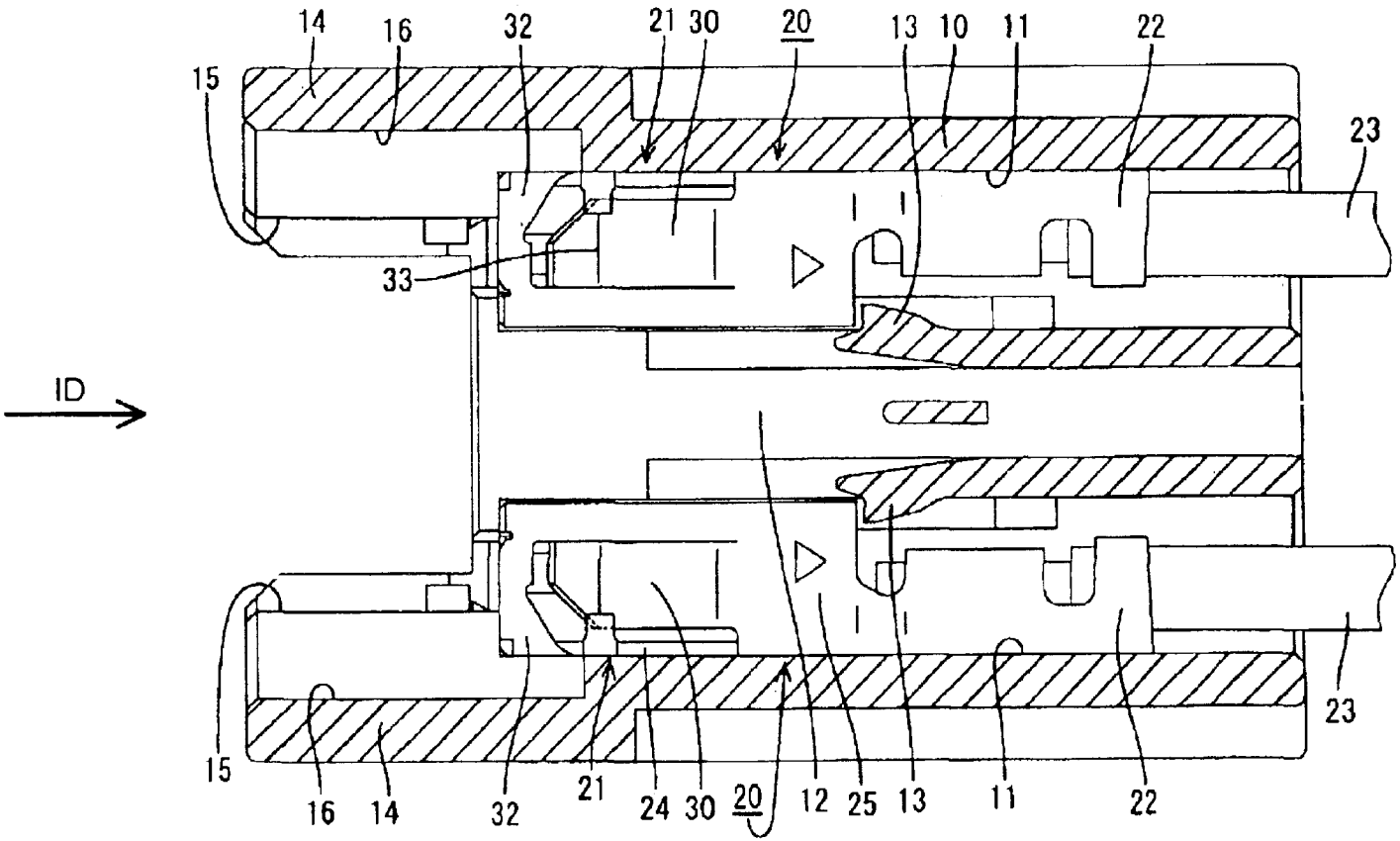
FIG. 3 is a vertical section showing a state where the terminal fittings are accommodated in the housing.
Figure 4:
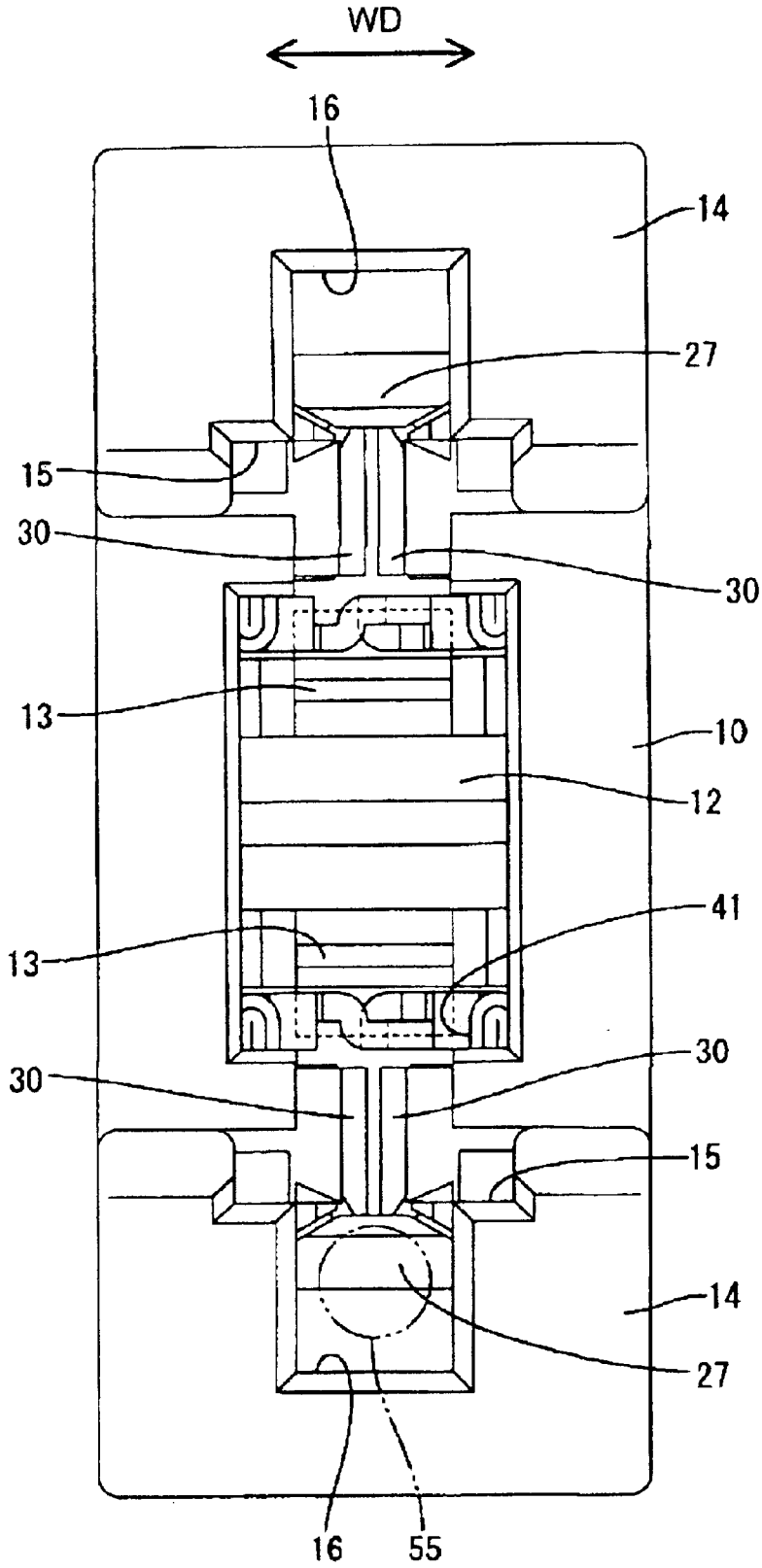
FIG. 4 is a front view showing the state where the terminal fittings are accommodated in the housing.
Figure 5:
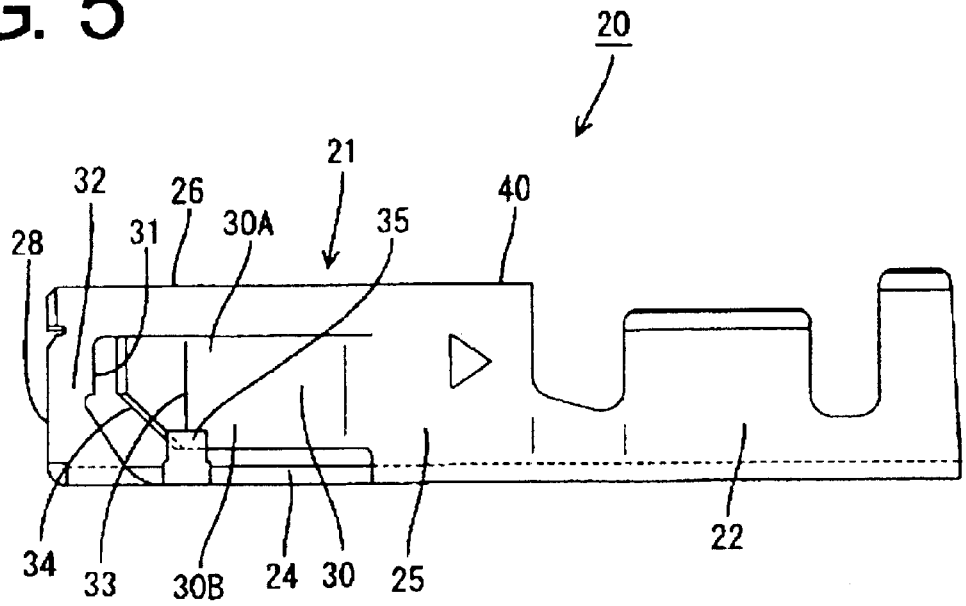
FIG. 5 is a side view of the terminal fitting.

A fuse connector according to the invention is illustrated in FIGS. 1 to 11 and is comprised of a housing 10 and at least one pair of terminal fittings 20 accommodated in the housing 10. A fuse 50 is mountable into the housing 10. A connecting side between the housing 10 and the fuse 50 is referred to herein as the front and a direction along which the terminal fittings 20 are arranged is referred to as the vertical direction.

The housing 10 has a substantially box shape, and at least one pair of vertically symmetrical cavities 11 are formed in the housing 10. Each cavity 11 has a substantially rectangular cross section and an inter-terminal space 12 is defined between the cavities 11. The cavities 11 and the inter-terminal space 12 are open in both front and rear end surfaces of the housing 10. Locks 13 are cantilevered forward (leftward in FIG. 1) from the partition walls between the cavities 11 and the inter-terminal space 12. The locks 13 are located at substantially middle positions along forward and backward directions FBD. The partition walls are cut at their widthwise-middle portions in an area of the housing 10 before the locks 13. Thus, the upper cavity 11, the inter-terminal space 12 and the lower cavity 11 communicate with each other.

Upper and lower guides 14 project forward from the front end surface of the housing 10. The guides 14 are adapted to guide the fuse 50 into the housing 10 from the front. Opposed surfaces of the guides 14 are configured to define a recess 15 between the guides 14. Accordingly, an inner space of the housing 10 is widened in correspondence of the recess 15.

Each guide 14 has a testing space 16 formed by vertically cutting off a widthwise middle of the recess 15 substantially normal to the forward and backward directions FBD. The upper testing space 16 corresponds substantially to an upper-half area of the upper cavity 11 and an area farther above the upper cavity 11. The upper testing space 16 is open at the front-end of the guide 14. On the other hand, the lower testing space 16 corresponds substantially to a lower-half area of the lower cavity 11 and an area further below the lower cavity 11. The lower testing space 16 is open in the front-end surface of the guide 14. An upper-end of the front surface of the terminal fitting 20 inserted into the upper cavity 11 and a lower-end of the front surface of the terminal fitting 20 inserted into the lower cavity 11 face the testing spaces 16, and are accessible from the front.

Figure 11:
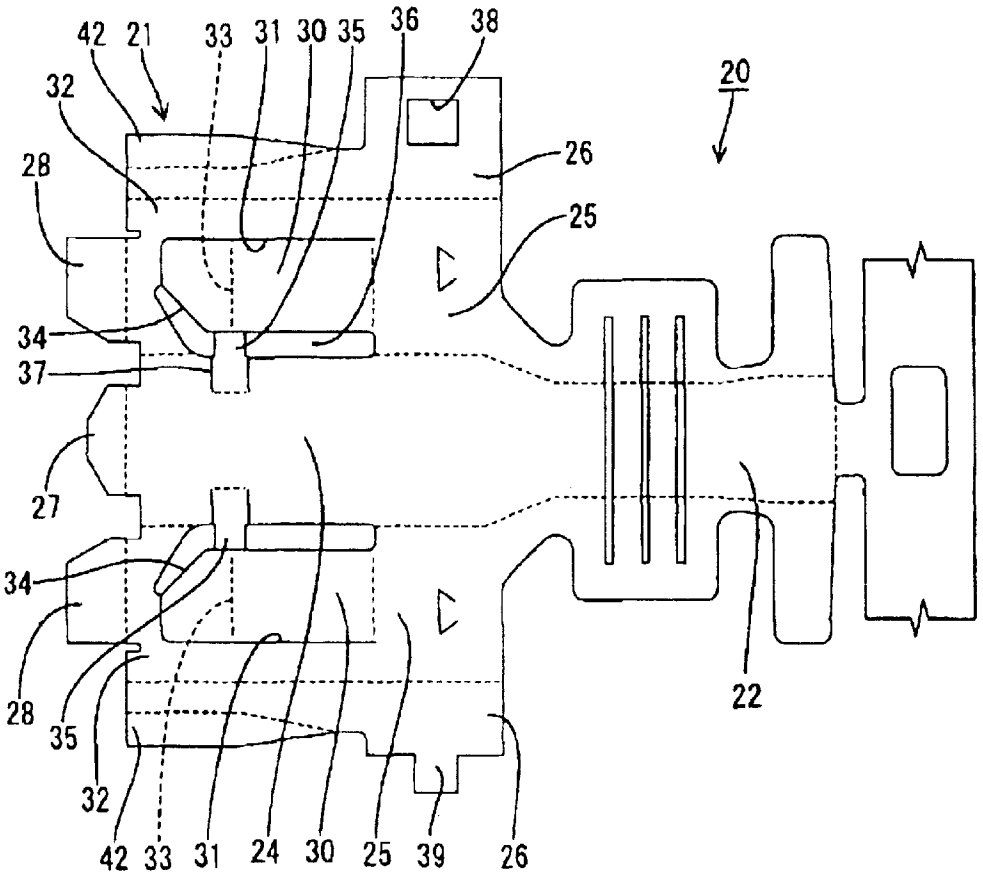
FIG. 11 is a development of the terminal fitting.

Each terminal fitting 20 is formed by bending, folding and/or embossing a conductive metallic plate that has been stamped or cut into a specified shape, as shown in FIG. 11. Additionally, each terminal fitting 20 is long and narrow along forward and backward directions FBD. A connecting portion 21 is formed at a front part of the terminal fitting 20, and is configured for connection with a tab terminal 52 of the fuse 50. A wire-crimping portion 22 is formed at a rear part of the terminal fitting 20 and defines an open barrel that can be crimped, bent or folded into connection with the wire 23.

The connecting portion 21 is comprised of a bottom wall 24 in the form of a substantially flat plate that is narrow and long along forward and backward directions FBD. Two substantially flat sidewalls 25 extend from opposite side edges of the bottom wall 24 and are aligned substantially normal to the bottom wall 24. The sidewalls 25 project toward the inter-terminal space 12 when the terminal fitting 20 is accommodated in the housing 10. Two substantially flat ceiling walls 26 extend in from the extending ends of the sidewalls 25 at substantially right angles. Accordingly, the ceiling walls 26 are placed one over the other and at least partly overlap.

Figure 9:
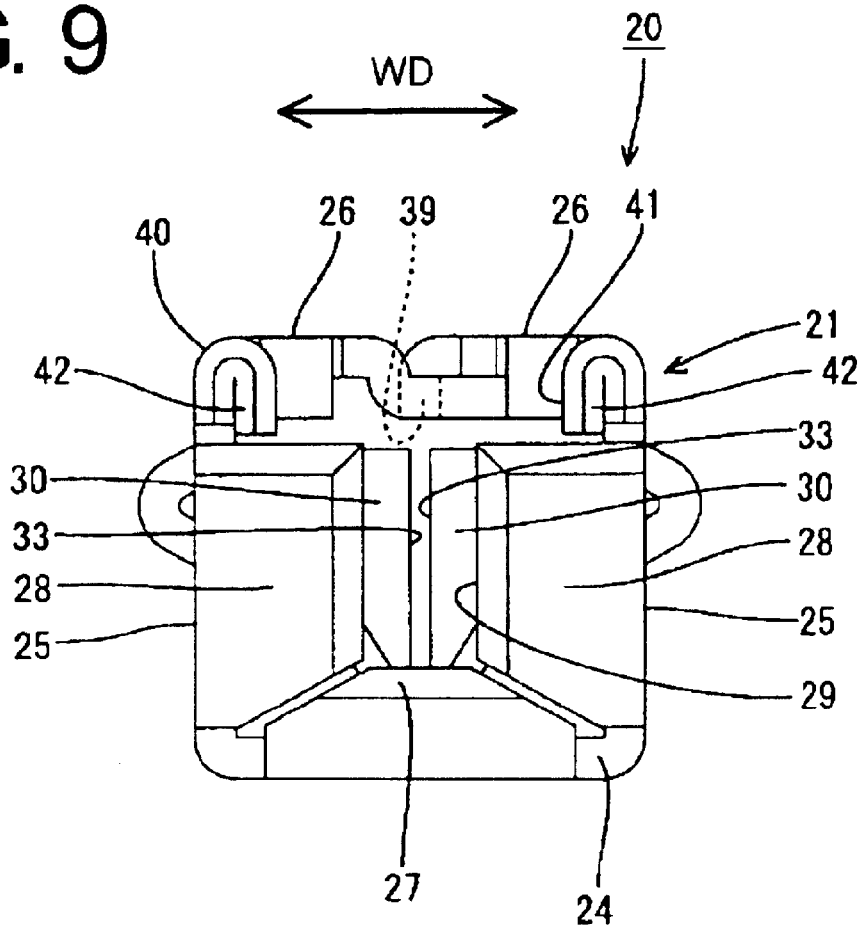
FIG. 9 is a front view of the terminal fitting.
Figure 10:
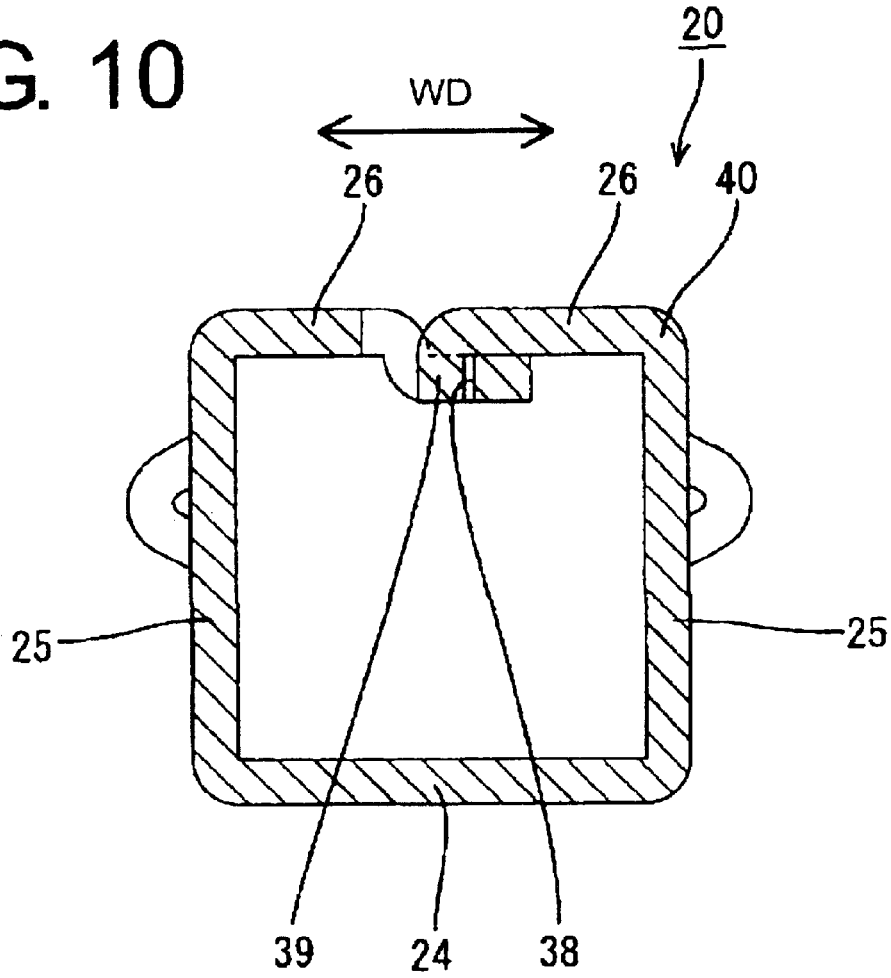
FIG. 10 is a lateral section of the terminal fitting.

A lower protection wall 27 projects up at a substantially right angle from the front edge of the bottom wall 24 and defines a substantially isosceles trapezoidal flat plate when viewed from the front (see e.g. FIG. 9). Further, substantially flat lateral protection walls 28 project inward at substantially right angles from the left and right sidewalls 25. The lower edges of the lateral protection walls 28 are sloped up toward the widthwise center, and substantially contact inclined upper edges of the lower protection wall 27 at the lateral sides. The front surfaces of the lower protection wall 27 and the lateral protection walls 28 are substantially normal to the longitudinal direction of the terminal fitting 20 and are substantially continuous and flush with each other. An insertion opening 29 is formed between the lateral protection walls 28 in the front surface of the connecting portion 21 and is configured for enabling insertion of the tab terminal 52 of the fuse 50 in an insertion direction ID. The width of the insertion opening 29 (i.e. its dimension along a widthwise direction WD) is slightly larger than the thickness of the tab terminal 52 so that clearances are defined along the widthwise direction WD between the lateral protection walls 28 and the tab terminal 52 in view of a dimensional tolerance.

Each sidewall 25 has a resilient contact piece 30 formed by cutting a part of the respective sidewall 25 and bending the cut part in. Thus, the formation of the resilient contact piece 30 creates an elongated opening 31 in the sidewall 25. The bottom edge of the opening 31 extends substantially along the bottom wall 24 and the upper edge of the opening 31 is lower than the upper edge of the sidewall 25. The opening 31 also has a front edge behind the front edge of the sidewall 25 and a rear edge before the rear edge of the sidewall 25. A substantially L-shaped frame 32 is defined on the sidewall 25 and extends along the front edge and upper edge of the opening 31. The lateral protection walls 28 extend from the front edges of the frame 32.

Each resilient contact piece 30 cantilevers forward from the rear edge of the opening 31 of the sidewall 25. When viewed from above (see FIGS. 2, 7 and 8), the resilient contact piece 30 extends obliquely in toward the front from the rear end of the opening 31 and is bent obliquely out near its front end. This bend defines a touching portion 33 for contacting the tab terminal 52 substantially along a vertical line. The touching portion 33 is substantially normal to an insertion direction ID of the tab terminal 52 into the housing 10. The tab terminal 52 can be inserted in the inserting direction ID and thrusts itself between the resilient contact pieces 30 so that the resilient contact pieces 30 deform resiliently out with the tab terminal 52 therebetween. The front ends of the resilient contact pieces are displaced forward toward the lower protection wall 27 and/or the lateral protection walls 28 as the resilient contact pieces 30 are deformed, and a bending angle of the touching portions 33 increases.

Figure 6:
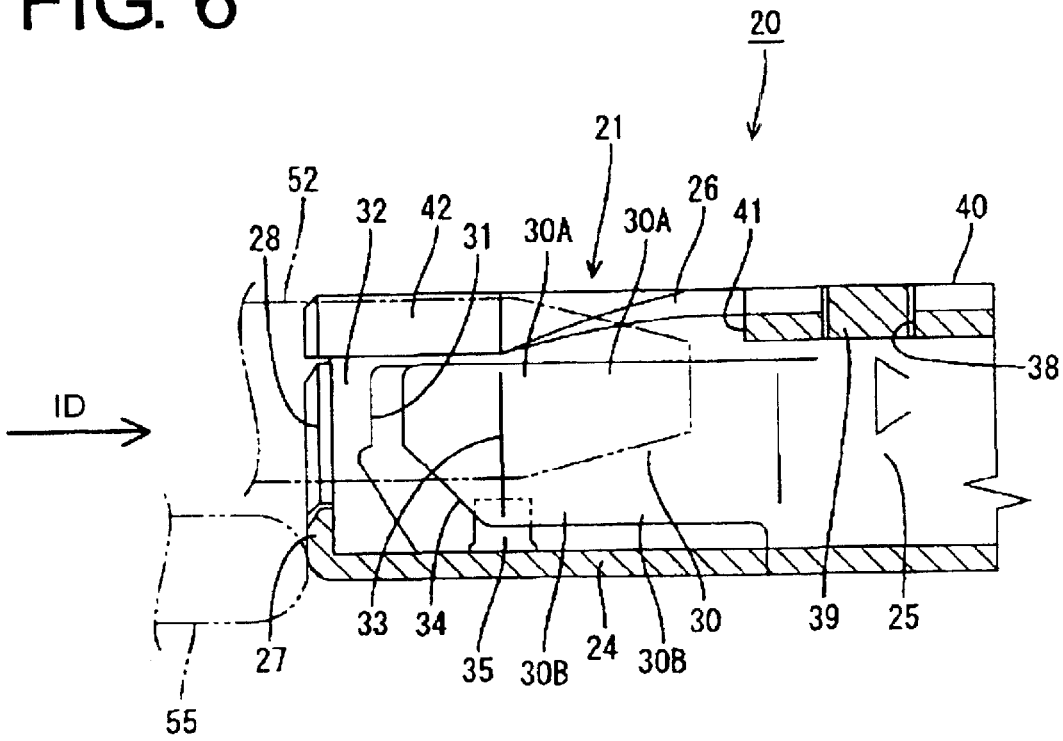
FIG. 6 is a partial enlarged vertical section of the terminal fitting.

A corresponding area 30A is defined on an upper area of the resilient contact piece 30 at the side of the inter-terminal space 12 and contacts or overlaps the tab terminal 52 along the vertical direction. A noncorresponding area 30B is defined on a lower area of the resilient contact piece 30 closer to the bottom wall 24 and, as shown in FIG. 6, is neither in contact with nor corresponds to the tab terminal 52. A cut edge 34 is formed at the front end of the noncorresponding portion 30B. The cut edge 34 slopes away from the front end of the corresponding portion 30A and obliquely down toward the bottom wall 24 with respect to the inserting direction ID. The cut edge 34 is formed in an area before the touching portion 33 and substantially corresponds to the lower protection wall 27 with respect to the vertical direction. The height of the lower protection wall 27, the position of the cut edge 34 of the corresponding portion 30A with respect to forward and backward directions FBD, the height of the corresponding portion 30A from the bottom wall 24, and the position of the front end of the noncorresponding portion 30B with respect to forward and backward directions FBD all are set so that the lower protection wall 27 does not interfere with the resilient contact pieces 30. This avoidance of interference is assured even if the lower protection wall 27 is inclined back and the resilient contact piece 30 is elongated forward by the contact with the tab terminal 52.

Left and right projections 35 project from the bottom wall 24. A necessary height of the projections 35 is achieved by clearances 36 between the lower edges of the resilient contact pieces 30 and the lower edges of the openings 31 and cuts 37 made in the bottom wall 24 to extend inward in a development, as shown in FIG. 11. The projections 35 are at outer sides of the touching portions 33 of the resilient contact pieces 30. Thus, the resilient contact pieces 30 will contact the projections 35 after a degree of resilient deformation that lies in a range below the resiliency limit. As a result, the resilient contact pieces 30 cannot be deformed excessively.

A substantially rectangular locking hole 38 is formed at a rear part of one of the ceiling walls 26, and a substantially rectangular locking piece 39 projects from the inner edge of a rear part of the other ceiling wall 26. The locking piece 39 is bent toward the bottom wall 24 and engages the locking hole 38. Thus, a closed continuous substantially rectangular tube 40 is formed at a rear part of the connecting portion 21 and is defined by the bottom wall 24, the sidewalls 25 and the ceiling walls 26. The inner edge of the ceiling wall 26 that has the locking hole 38 is recessed toward the bottom wall 24 by substantially the wall thickness. Thus, upper surfaces of the two ceiling walls 26 are substantially continuous and flush with each other (see FIG. 10).

Figure 7:
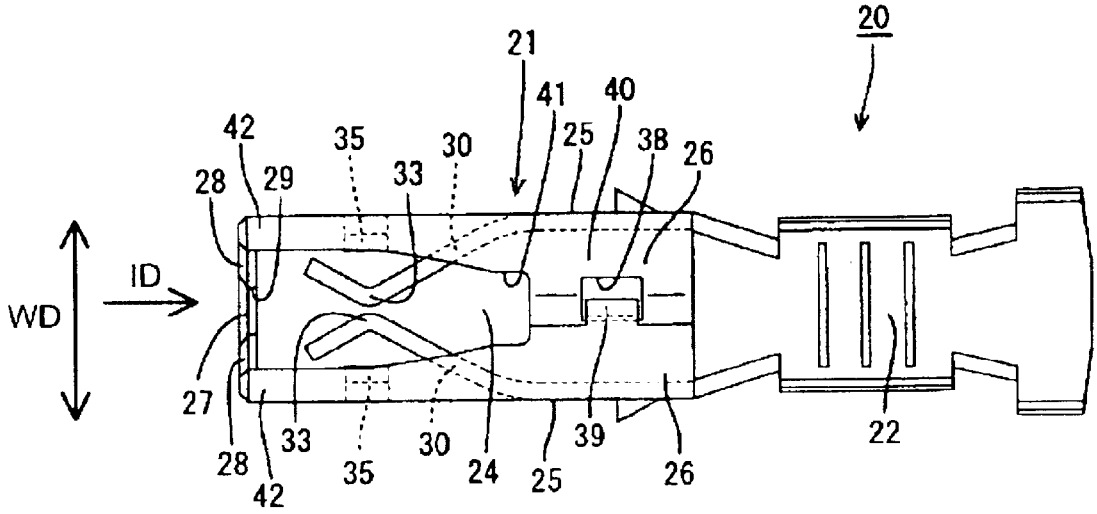
FIG. 7 is a plan view of the terminal fitting.
Figure 8A:
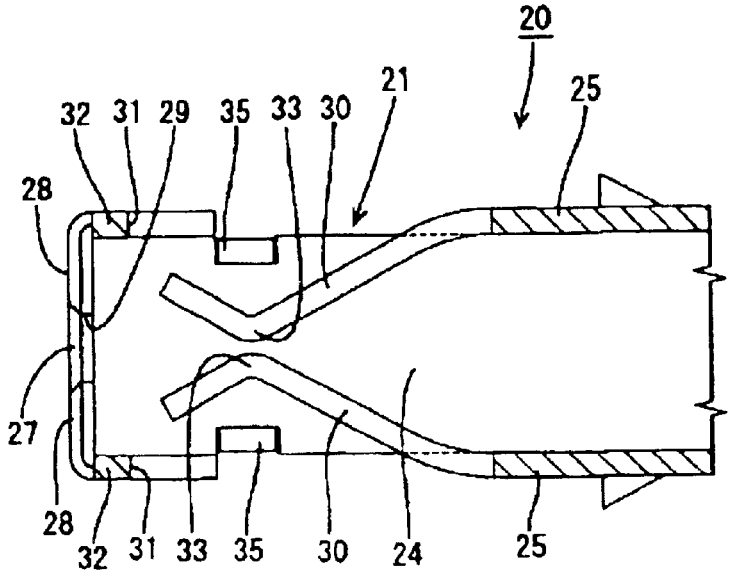
FIGS. 8(A) and 8(B) are a partial enlarged horizontal section of the terminal fitting and a partial enlarged horizontal section of the terminal fitting connected with the fuse.
Figure 8B:
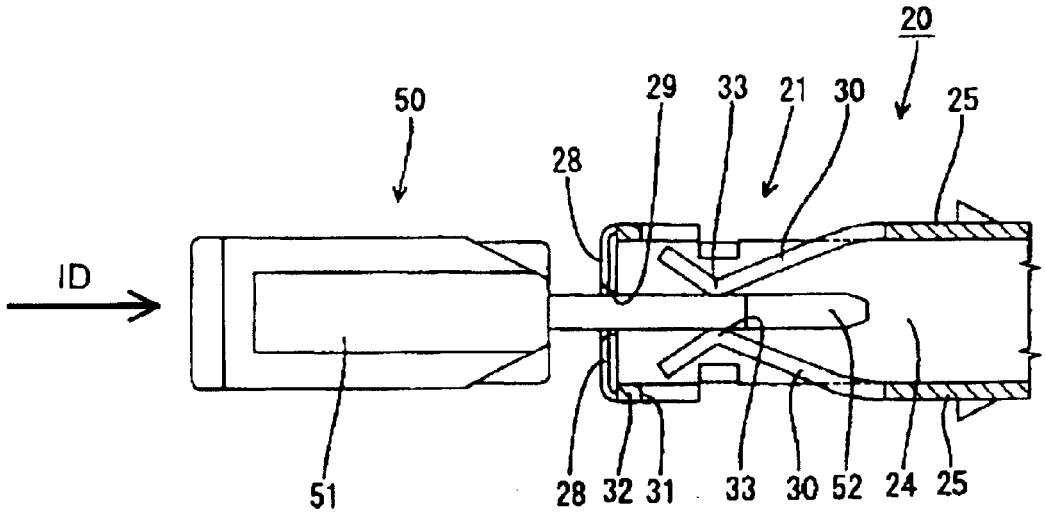

The inner edges of the two ceiling walls 26 are cut in areas before the rectangular tube 40 to form an insertion opening 41 that is long along forward and backward directions FBD when viewed from above (see FIG. 7). Thus, the front edges of the resilient contact pieces 33, including the touching portions 33, are exposed to the outside. The insertion opening 41 is open in the front ends of the ceiling walls 26 and communicates with the insertion opening 29. Accordingly, the tab terminal 52 can enter the insertion openings 41, 29 from the front and along the inserting direction ID (see e.g. FIG. 6).

Long narrow laid-over panels 42 are defined at front parts of the ceiling walls 26 to the left and right of the insertion opening 41. The laid-over panels 42 are bent down towards the bottom wall 24 and are held in close contact with the inner surfaces of the frames 32 of the sidewalls 25. The laid-over panels 42 extend back from the front edges of the frames 32. The lower edges of the laid-over panels 42 are at substantially the same height as the upper edges of the lateral protection walls 28. Thus, the laid-over panels 42 are above the lateral protection walls 28 when viewed from the front. Further, when viewed from above (see FIG. 7), the projections 35 are hidden at least partly by the laid-over panels 42. Additionally, the inner edges of the ceiling walls 26 are continuous with the laid-over panels 42 and are bent to be laid over gradually more toward the front in an area from the rear ends of the laid-over portions 42 to the back end of the insertion opening 41.

The fuse 50 has a substantially rectangular box-shaped casing 51 that accommodates a fusible portion (not shown). Upper and lower tab terminals 52 project back toward the housing 10 from the casing 51. The fuse 50 is mountable into the housing 10 from the front and along the inserting direction ID.

The terminal fitting 20 is inserted into the lower cavity 11 of the housing 10 from behind with the bottom wall 24 located at the bottom. The terminal fitting 20 is locked therein by engagement of the lock 13 with the rear edge of the rectangular tube 40. A second terminal fitting 20 is inverted and inserted into the upper cavity 11 from behind so that the bottom wall 24 is at the top. The second terminal fitting 20 is locked therein by the lock 13. The two terminal fittings 20 in the housing 10 are vertically symmetrical and define the inter-terminal space 12 therebetween. Additionally, the insertion openings 41 of the terminal fittings 20 are substantially opposed to each other. Further, the lower protection walls 27 at the front ends of the respective terminal fittings 20 substantially face the testing spaces 16 of the housing 10.

In this state, the fuse 50 is mounted into the housing 10 from the front. Thus, the upper and lower tab terminals 52 enter the upper and lower cavities 11 while the casing 51 is guided by the recesses 15. The tab terminals 52 are inserted into the connecting portions 21 through the insertion openings 29 at the front ends of the respective terminal fittings 20 and thrust themselves between the left and right resilient contact pieces 30. This causes the resilient contact pieces 30 to be deformed resiliently outward and to hold the tab terminals 52 from left and right sides by the resilient restoring forces thereof. As a result, the tab terminals 52 and the resilient contact pieces 30 are connected with a specified contact pressure to connect the upper and lower terminal fittings 20 electrically via the fuse 50.

The resilient contact pieces 30 and the tab terminals 52 are displaced vertically when the fuse 50 is mounted, and the corresponding portions 30A of the resilient contact pieces 30 at the side of the inter-terminal space 12 contact areas of the tab terminals 52 at the side of the bottom wall 24. However, areas of the tab terminals 52 at the side of the inter-terminal space 12 do not engage the resilient contact pieces 30. The tab terminals 52 and the connecting portions 21 do not interfere with each other because the ceiling walls 26 of the terminal fittings 20 have the insertion opening 41.

An electrical connection test for the terminal fittings 20 in the housing 10 is conducted by a probe 55. The probe 55 is inserted into the testing space 16 from the front of the housing 10 and is brought into contact with the terminal fitting 20. The lower protection wall 27 faces the testing space 16. Thus, the probe 55 contacts the front surface of the lower protection wall 27. The lower protection wall 27 is before the resilient contact pieces 30. As a result, the probe 55 does not interfere with or catch the resilient contact pieces 30. An inserting position of the probe 55 could be displaced toward the inter-terminal space 12. However, the probe 55 contacts the lateral protection walls 28 and does not come into contact with the resilient contact pieces 30.

As described above, the frames 32 prevent external matter (not shown) from contacting the resilient contact pieces 30 from the front, from the side or from above while the terminal fittings 20 is detached from the housing 10. Further, the bottom wall 24 prevents external matter from interfering with the resilient contact pieces 30 from below.

Further, the upper edges of the frames 32 are folded and laid over to define laid-over portions 42. Thus, the frames 32 are more rigid and are less likely to be deformed by external matter in a manner that would permit the external matter to interfere with the resilient contact pieces 30.

The extending ends of the side walls 25 are connected by the ceiling walls 26 in the areas of the side walls 25 behind the resilient contact pieces 30 to form the rectangular tube 40 comprised of the bottom wall 24, the side walls 25 and the ceiling walls 26. The rectangular tube 40 is difficult to deform. Thus, the sidewalls 25 and the frame-shaped portions 32 continuous with the rectangular tube 40 also are difficult to incline inward or outward, and interference of external matter with the resilient contact pieces 30 is unlikely.

The rectangular tube 40 is at least partly behind the resilient contact pieces 30, and is not a hindrance when the tab terminal 52 of the fuse 50 is mounted from the front and into contact with the resilient contact pieces 30.

The lower protection wall 27 stands up from the front edge of the bottom wall 24 and the lateral protection walls 28 extend in from the front edges of the left and right side walls 25. External matter smaller than a spacing between the side walls 25 may approach from the front. However, interference of the external matter with the resilient contact pieces 30 is prevented by the lateral protection walls 28 and the lower protection wall 27. Furthermore, the upper edge of the lower protection wall 27 and the lower edges of the lateral protection walls 28 are in proximity or in contact. Thus, the lateral protection walls 28 and the frame-shaped portions 32 will not incline inward. Therefore, interference of external matter with the resilient contact pieces 30 due to deformation of the frames 32 is prevented.

The outer sides of the resilient contact pieces 30 are exposed to the outside through the openings 31 left in the side walls after forming the resilient contact pieces 30. Thus, there is a possibility that external matter will interfere sideways with the resilient contact pieces 30 from the outside. However, the projections 35 are at the outer sides of the resilient contact pieces 30. Thus, the projections 35 protect the resilient contact pieces 30 from interference by external matter that is smaller than the opening 31 and that comes closer sideways.

The projections 35 also prevent the resilient contact pieces 30 from undergoing an excessive resilient deformation by contacting the resilient contact pieces 30. Thus, the shape of the terminal fitting 20 is simple as compared to a case where excessive deformation preventing portions are formed separately from the projections 35.

The probe 55 could cause the lower protection wall 27 to incline back toward the resilient contact pieces 30. However, the probe 55 will not interfere with the resilient contact pieces 30 because the cut portions 34 are formed at the front end of the resilient contact pieces 30. Thus, there is no likelihood of damaging the resilient contact pieces 30.

Each resilient contact piece 30 has the corresponding portion 30A that corresponds to the tab terminal 52 of the fuse 50 and the vertically tall noncorresponding portion 30B that does not correspond to the tab terminal 52. Thus, the rigid resilient contact pieces 30 achieves a high contact pressure.

The cuts 34 are formed in the areas of the resilient contact pieces 30 before the touching portions 33 with the tab terminals 52. Thus, the resilient contact pieces 30 are wide from the base ends supported on the sidewalls 25 to the touching portions 33. Therefore, the high spring rigidity of the resilient contact pieces 30 is ensured of providing a high contact pressure.

Part of the probe 55 could be displaced up from the lower protection wall 27 towards the resilient contact pieces 30. Contact of the probe 55 with the upper extending end of the lower protection wall 27 could deform the lower protection wall 27. However, the front surfaces of the lateral protection walls 28 are substantially flush with the front surface of the lower protection wall 27 and the lower edges of the lateral protection walls 28 are in proximity to or in contact with the upper edges of the lower protection wall 27. Thus, an upwardly displaced probe 55 will contact both the lower protection wall 27 and the lateral protection walls 28. Accordingly, a pushing force given by the probe 55 will be exerted both on the lower protection wall 27 and on the lateral protection walls 28, thereby reducing the pushing force on the lower protection wall 27. Therefore, deformation of the lower protection wall 27 is prevented.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The resilient contact pieces extend substantially forward in the foregoing embodiment. However, they may extend backward or toward the inter-terminal space according to the present invention.

The resilient contact pieces are supported at one end in the foregoing embodiment. However, they may have both ends supported on the sidewalls.

Only the edges of the frame-shaped portions at the side of the inter-terminal space are folded and laid over in the foregoing embodiment. However, other portions may be folded and laid over according to the present invention.

The rectangular tube is behind the resilient contact pieces in the foregoing embodiment. However, there may be no rectangular tube.

The lower protection wall stands up from the front edge of the bottom wall in the foregoing embodiment. However, there may be no lower protection wall according to the present invention.

The lateral protection walls are at the front edges of the sidewalls in the foregoing embodiment. However, there may be no lateral protection wall.

The projections stand up from the bottom wall in the foregoing embodiment. However, such a projection is not required.

The projections act as the excessive deformation preventing means in the foregoing embodiment. However, excessive deformation preventing portions may be formed separately from the projections.

The cut portion extends obliquely in the foregoing embodiment. However, it may have a rectangular shape according to the invention.

The cut portion is formed in an area of each resilient contact piece before the touching portion engageable with the tab terminal in the foregoing embodiment. However, the cut portion it may be formed in an area behind the touching portion according to the present invention.

The sidewalls extend more forward than the resilient contact pieces in the foregoing embodiment. However, the front ends of the sidewalls may be behind the front ends of the resilient contact pieces according to the invention. In such a case, the lateral protection walls are not formed.

The front surfaces of the lateral protection walls and of the contact are substantially flush and the lower edges of the lateral protection walls contact the upper edge of the contact in the foregoing embodiment. However, the lateral protection walls may be slightly behind the contact according to the present invention. Even in such a case, if the contact is inclined backward, the probe contacts the lateral protection walls before contacting the inclined contact portion. Therefore, further backward inclination of the contact is prevented.

Even though the invention was described with reference to a fuse connector and to a terminal fitting for a fuse connector, it should be understood that the invention is also applicable for wire-end connectors connectable to a mating wire-end connector, to a mating printed circuit board connector, to a mating device connector, to a mating panel connector, etc.

The invention has been described with reference to a terminal fitting having two resilient contact pieces. However, the invention is also applicable to terminal fittings and their connectors having only one resilient contact piece to be brought into contact with the corresponding tab terminal.

What is claimed is:

1. A fuse connector for a fuse having a pair of tab terminals, the fuse connector comprising:

a housing having opposite front and rear ends, the front end of the housing being configured for receiving at least part of the fuse;

at least two terminal fittings accommodated in the housing, each of said terminal fittings having a base wall with opposite front and rear ends, opposed sidewalls extending from the base wall, resilient contact pieces formed unitarily with the respective sidewalls and bent inwardly relative to the respective sidewalls, the resilient contact pieces being configured for contacting the tab terminals of the fuse when the fuse is received in the housing, portions of each said terminal fitting rearward of the resilient contact pieces including a rectangular tube defined by the base wall, the sidewalls and at least one ceiling wall opposed to the base wall, portions of the terminal fitting opposed to the base wall and forward of the ceiling wall being open, a protection wall projecting in at the front end of the base wall and auxiliary protections walls extending in at the front ends of the sidewalls, the side walls defining frame pieces extending from the auxiliary protection walls to the rectangular tube for protecting the resilient contact pieces from contact laterally.

2. The fuse connector of claim 1, wherein the housing has an inter-terminal space symmetrically between the two terminal fittings.

3. The fuse connector of claim 1, further comprising a laid-over panel folded and laid over at least a part of the frame.

4. The fuse connector of claim 1, wherein projections stand up the base wall between the respective sidewalls and the corresponding resilient contact pieces.

5. The fuse connector of claim 4, wherein the projections are disposed and dimensioned for preventing the corresponding resilient contact pieces from undergoing an excessive resilient deformation beyond their resiliency limit.

6. A terminal fitting comprising: a base wall having opposite front and rear ends, opposed sidewalls extending from the base wall, resilient contact pieces formed unitarily with the respective sidewalls and bent inwardly from the respective sidewalls, portions of each said terminal fitting rearward of the resilient contact pieces including a rectangular tube defined by the base wall, the sidewalls and at least one ceiling wall opposed to the base wall, portions of the terminal fitting opposed to the base wall and forward of the ceiling wall being open a protection wall projecting in at the front end of the base wall and auxiliary protection walls extending in at front ends of the sidewalls, the side walls defining frame pieces extending from the auxiliary protection walls to the rectangular tube for protecting the resilient contact pieces from contact laterally.

7. The terminal fitting of claim 6, further comprising laid-over panels folded from edges of the respective sidewalls opposite the base wall and laid over at least a part of the sidewall to lie in face-to-face relationship with portions of the sidewalls for making portions of the sidewall forward of the rectangular tube more rigid and less likely to deform.

8. The terminal fitting of claim 7, wherein projections stand up from the base wall between the respective sidewalls for contacting the corresponding resilient contact pieces for preventing excessive deformation on the resilient contact pieces.

9. A fuse connector for a fuse having a pair of tab terminals, the fuse connector comprising:

a housing having opposite front and rear ends, the front end of the housing being configured for receiving at least part of the fuse;

at least two terminal fittings accommodated in the housing, each of said terminal fittings having a base wall and first and second opposed sidewalls extending from the base wall, forwardly cantilevered resilient contact pieces formed unitarily with the respective sidewalls and bent inwardly relative to the sidewalls, each resilient contact piece having a corresponding portion disposed for contact with the corresponding tab terminal when the fuse is received in the housing and a noncorresponding portion disposed to avoid contact with the tab terminal, each noncorresponding portion having a cut edge at a front end of the resilient contact piece, the cut edge extending obliquely back from the corresponding portion, and a protection wall projecting at a front edge of the base wall and substantially aligned with the noncorresponding portion, the protection wall being disposed in the housing for contact by a probe.

10. The fuse connector of claim 9, wherein the cut portion is formed in an area of each resilient contact piece located before a touching portion engageable with the tab terminal.

11. The fuse connector of claim 9, wherein the sidewalls extend more forward than the front ends of the resilient contact pieces and are formed with lateral protection walls extending inward at front edges of the sidewalls.

12. The fuse connector of claim 11, wherein front surfaces of the lateral protection walls and a front surface of the contact portion are substantially flush and corresponding edges of the lateral protection walls substantially contact inner edges of the contact portion.

13. A terminal fitting having a base wall and at least one sidewall extending from the base wall, a forwardly cantilevered resilient contact piece formed unitarily with the sidewall and bent inwardly relative to the sidewall, the resilient contact piece having a corresponding portion disposed for contact with a tab terminal and a noncorresponding portion disposed to avoid contact with the tab terminal, the noncorresponding portion having a cut edge at a front end of the resilient contact piece, the cut edge extending obliquely back from the corresponding portion, and a protection wall projecting at a front edge of the base wall and substantially aligned with the noncorresponding portion, wherein the sidewall extends forward from the front end of the resilient contact piece and a lateral protection wall extends in at a front edge of the sidewall.

14. The terminal fitting of claim 13, wherein the cut edge is formed in an area of the resilient contact piece located before a touching portion engageable with the tab terminal.

15. The terminal fitting of claim 13, wherein a front surfaces of the lateral protection wall and a front surface of the contact portion are substantially flush and an edge of the lateral protection wall substantially contact an inner edge of the contact portion.

* * * * *